United States Patent [19]

Hörtnagel

[11] 4,393,785

[45] Jul. 19, 1983

[54] SUSPENDED TRACK FOR MONORAIL SUSPENDED TROLLEYS

[75] Inventor: Franz Hörtnagel, Oberperfuss, Austria

[73] Assignee: Firma R. Stahl GmbH & Co., Stuttgart-Wangen, Fed. Rep. of Germany

[21] Appl. No.: 247,524

[22] Filed: Mar. 25, 1981

[30] Foreign Application Priority Data

May 21, 1980 [DE] Fed. Rep. of Germany ..... 3019301

[51] Int. Cl.[3] ..... E01B 25/22

[52] U.S. Cl. ..... 104/110; 104/93; 104/111; 105/150; 191/29 R; 191/32

[58] Field of Search ..... 104/89, 93, 106, 110, 104/111; 105/150; 191/29 R, 32, 22 R; 339/20, 21 R, 215, 22

[56] References Cited

U.S. PATENT DOCUMENTS 3,625,158 12/1971 Lorenz et al. ..... 104/110
3,922,970 12/1975 Glastra ..... 104/111 X

FOREIGN PATENT DOCUMENTS 30647 11/1980 European Pat. Off. ..... 104/110
1289085 2/1969 Fed. Rep. of Germany ..... 104/111
1603176 12/1969 Fed. Rep. of Germany ..... 104/93
1806381 5/1970 Fed. Rep. of Germany .
2342777 of 1975 Fed. Rep. of Germany .
2343502 4/1975 Fed. Rep. of Germany .
2516420 11/1976 Fed. Rep. of Germany ..... 104/93
577431 7/1976 Switzerland ..... 104/93

*Primary Examiner*—Robert B. Reeves
*Assistant Examiner*—David F. Hubbuch
*Attorney, Agent, or Firm*—Frishauf, Holtz, Goodman & Woodward

[57] ABSTRACT

To permit attachment of a suspended track without drilling of holes lfor installation and connection to support elements (25), the track has an upper hollow structural section (2), for example in essentially semi-circular shape with depending vertical sections (10), a similar lower hollow structural section (2) joined by a connecting web (3), the sections in the web are unitary, the web being of generally horizontal C-shape in cross section, with a generally vertical back portion (11), mutually converging or approaching forward portions (5) which are bent over themselves to form diverging wing portions (6) leaving a groove-like gap (4) therebetween, the ends (7) of the portions (5) and the diverging wing portions (6). Hanger elements (25) can be longitudinally positioned by clamping the hanger elements against internally positioned clamping bars or plates (27), permitting longitudinal alignment by relative sliding of the clamping bars within the C-shaped chamber. Electrical connection bus ways and the like can be applied at the side opposite the gap by snap clips (22) snapped over the web (3) where it is rounded to form the C-shape.

20 Claims, 14 Drawing Figures

SUSPENDED TRACK FOR MONORAIL SUSPENDED TROLLEYS

The present invention relates to a track and track way and track system for suspended trolleys, particularly for trolleys for use in industrial installation or for hauling raw materials, coal, minerals, and the like, and in which the track way includes upper and lower hollow structural sections connected by a web to which suspension hangers can be attached, the trolleys having rolling engagement with one or both of the hollow sections.

BACKGROUND

Suspended track ways and track systems are used in suspension trolley arrangements for suspended above-ground transport of various products. The trolleys themselves may be pulled by cables, operate under gravity, or include drive motors receiving power and control signals over electrical connecting buses or rails secured to the track way. A track system of this type is described in German Patent De-PS No. 1 806 381, which has a lower shaped or profiled body formed as a circular tube, and an upper similarly shaped profiled body. The two circular tubes are connected by a web which is welded to the tubes. Manufacture of such a track way is comparatively expensive and material and energy intensive. It is difficult to attach current supply and control signal tracks, since they must be connected by insulating holders to the connecting web which, then, must be drilled or otherwise perforated or formed with slots in which the insulators for the electrical connection and power buses can be placed. Slots and holes also are required in order to attach holders or suspension elements to suspend and secure the tracks, from time to time, on suitable brackets, posts, pylons, and the like. Attachment of the track way to holders requires extensive design and anticipatory machining; such track ways frequently are many kilometers long. It is frequently difficult to precisely predetermine the location of all suspension supports due to the terrain involved. It is thus necessary to fit the suspensions in openings and holes which must be drilled during installation; pre-drilled suspension or support holes, made before assembly of the track ways, have to be matched to the local requirements of the supports themselves. Exact matching is required and any errors or other deviations in positioning of the support holders or suspension elements with respect to the track way can be compensated only with great difficulties. The time for assembling such a track way, with associated current connecting bus ways and tracks, as well as of the necessary switching and engagement elements to control track positioning and movement of trolleys thus is comparatively high. Pre-assembly and pre-positioning of attachment holes and openings is possible only to a limited extent, and many attachment holes have to be field-installed.

Another track way which has been proposed has an essentially U-shaped cross section forming an upper open and a lower open hollow shaped portion, which portions are connected by a unitary connecting web. The track way can be made as an extruded shaped or profiled element (see for example German Patent Disclosure Document DE-OS No. 23 43 502).

THE INVENTION

It is an object to provide a track way for monorail suspension trolleys, which can extend, self-supported, over substantial spans, which is inexpensive and simple to make, and easy to install and to fit locally prevailing conditions.

Briefly, an upper hollow structural section and a lower hollow structural section are connected by a connecting web which is formed without openings, and adapted to be supported by hanger elements which extend laterally from the web and can be clamped thereto. The web also carries and supports electrical connection tracks or rails to supply power to the trolleys and/or control signals. In accordance with the invention, the connecting web is a unitary, integral element which is of—in cross section—generally C shape, that is, has a generally vertically extending back portion which is unitarily joined to mutually converging or approaching forward portions leaving, between the ends, a groove-like open gap with re-entrant pockets. The outer portions of the pockets are defined by mutually diverging wings which extend upwardly and downwardly, respectively, away from the gap. The wing portions merge into the structural hollow profile sections, and are extended to form the upper and lower hollow structural portions respectively, of the sections. The hollow structural portions or sections preferably are, in cross section, approximately semi-circular.

The entire structure can be formed as a cold-rolled formed or shaped profiled rail, and has substantial vertical strength, and is resistant against twisting due to the unitary web which can be reinforced at the mutually converging wing portions by the ends of the structural rail, which can be fitted between the inner and outer sectional elements defining the ends of the C, and forming the wing portions. Yet, the track is capable of being bent. Attachment of the track section is simple since the hanger supports can be fitted with divergent, upwardly and downwardly extending projections, which fit into the pocket-like end portions of the groove-like opening. No fixed longitudinal connection is necessary, the suspension elements being clamped into the open C-like portion and capable of being positioned anywhere longitudinally with respect to the track by sliding the suspension elements in the C-like pockets or grooves, so that installation of the track way is substantially facilitated.

The cross section of the track way, with the extending wing portions, can also be considered to have, generally, the shape of a horizontally placed Ω. With little material and manufacturing requirements, a track way of high stability, support capability and strength, and resistance against twist is thus obtained.

The longitudinally extending pocket, open at the groove-like opening, permits elimination of formation of pre-punched holes for suspension hangers, positioning of switching control or other engagement elements and the like. Precise placement of the track way thus is possible by simple positioning of the support hangers, along the longitudinal extent of the pocket-like opening where necessary. Current supply tracks, for example in the form of electrical connecting rails or buses within an elongated insulating section can be readily attached to the web, for example by clamping or other clamping or holding supports. The track way can be made as a cold-rolled section or profile structure, shaped and rolled from a rust-protected, hot-dipped and rolled zinc coated wide sheet metal strip. No additional welding of the track in longitudinal direction is necessary.

DRAWINGS

Figure 1:
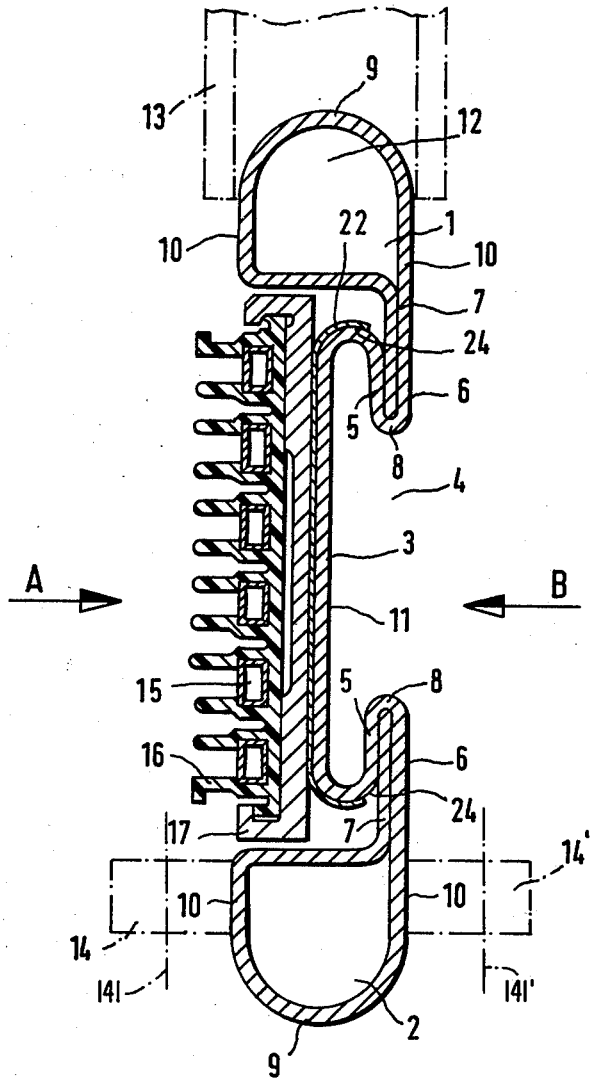
FIG. 1 is a general transverse cross-sectional view of the track way.
Figure 2:
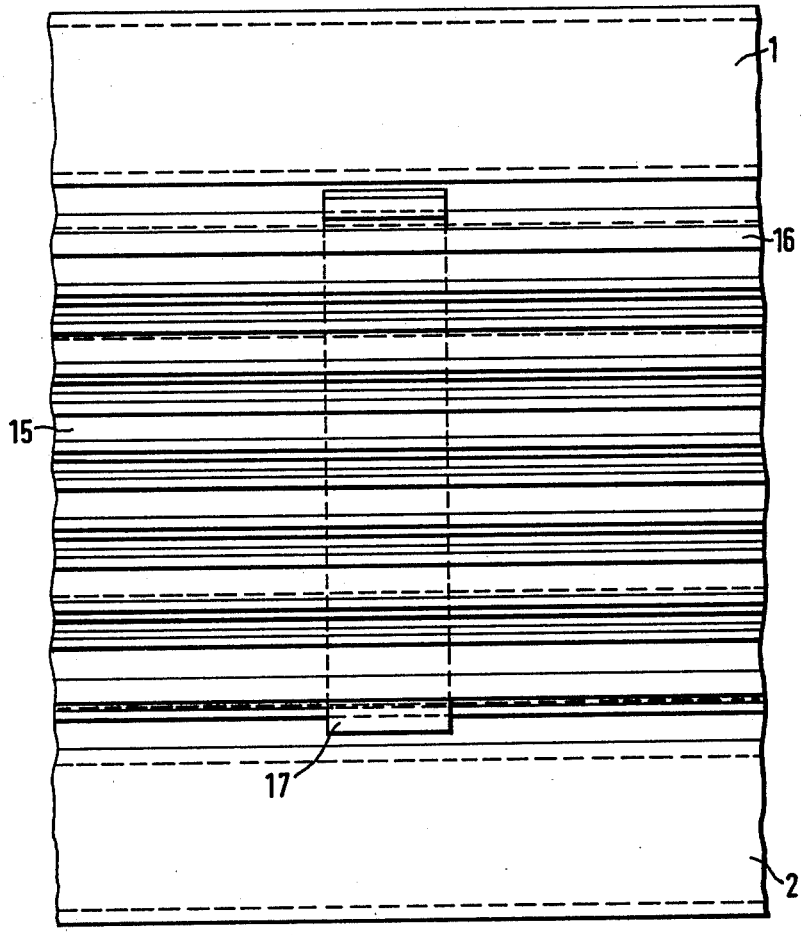
FIG. 2 is a fragmentary view of a track way taken in the direction of arrow A, FIG. 1.
Figure 3:
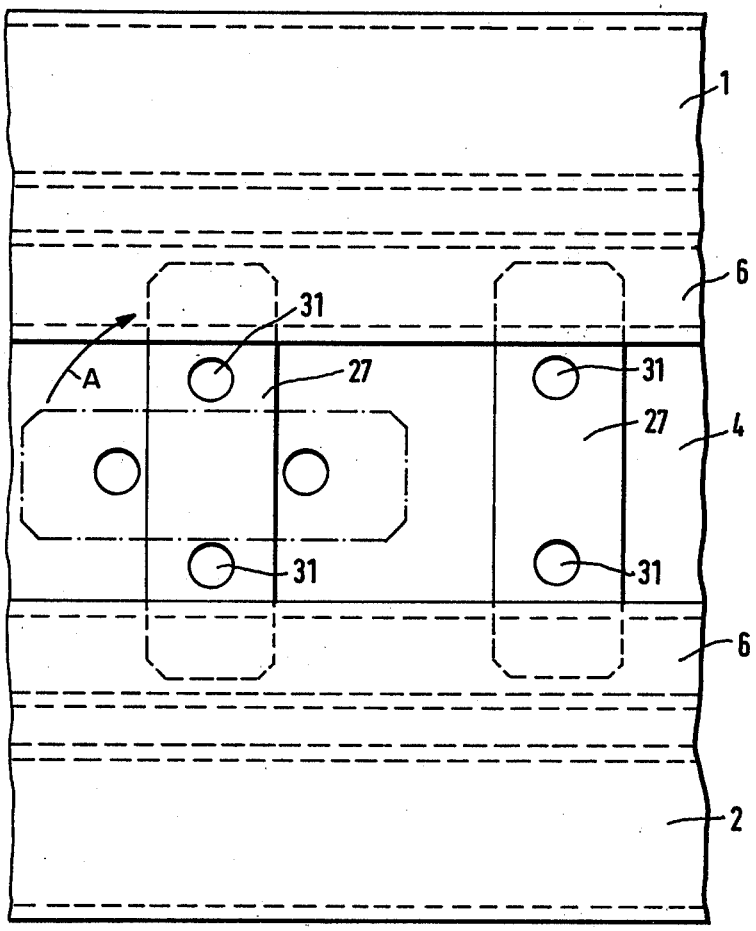
FIG. 3 is a fragmentary view of the track way taken in the direction of arrow B of FIG. 1 and illustrating placement of hanger supports.

The track way, best seen in FIGS. 1, 2 and 3, has an upper hollow profiled or section portion 1, and a lower profiled hollow or section portion 2, connected by a unitary web 3. The upper and lower portions 1, 2 form rail sections connected by the web 3. The combustion of the rail sections 1, 2 and the web 3 have, generally, the shape of a horizontally placed Ω in which a C-like opening or pocket is formed. The generally groove-like open portion 4, defined by the opening of the Ω or C, respectively, is limited or defined by two U-folded parallel wing portions 5, 6 at the upper and lower sides of the opening 4—see FIGS. 1, 3. The two hollow profiled rail portions 1, 2 have a unitary end strip 7 connected thereto which, as seen in FIG. 1, is placed between the associated U-shaped folded wing portions 5, 6 of the web 3, and clamped therebetween to be held in securely clamped, connected relation. The end portions 7 are supported at the bottom connecting portions 8 of the U-folded wings 5, 6. Thus, support extending transversely to the longitudinal direction of the track way of the rail portions 1, 2 is effectively obtained.

The entire track way is formed as a cold-rolled section or profiled shape from a sheet metal strip of suitable width, and is made without any welding being necessary. The track portions 1, 2 have the shape of closed chambers which, towards the outside, have essentially cylindrical outer surfaces 9, with the cross-sectional shape of, essentially, a semi-circle. The cylindrical surfaces 9 smoothly merge into vertical portions 10 which then extend towards the wing portions 6 and the open groove 4 within which the elongated pocket defined by the C-shaped web is located. The raw material, that is, the sheet metal strip, is preferably zinc-coated steel made by a dipped and hot-rolled zinc coating process.

The center or back portion 11 of the web 3 preferably is symmetrically positioned with respect to a longitudinal central plane 12 passing through the track. It is set inwardly with respect to the rail portions 1, 2.

Figure 4:
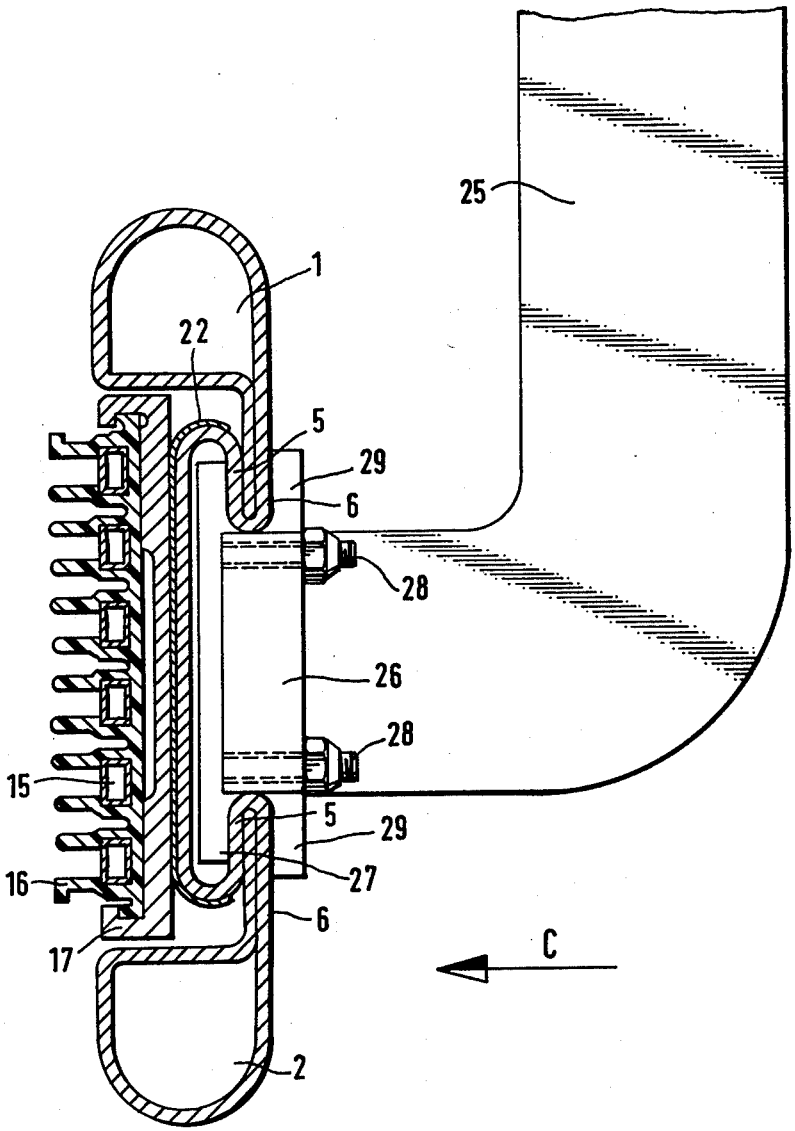
FIG. 4 is a view of the track way of FIG. 1 together with a hanger support and illustrating how the track way can be suspended.

The track way is suspended by suspension holders fitted into the groove-like pocket which is open at the opening 4—see FIG. 4. Trolleys can run and be suspended from the upper rail portion 1, for example by engagement of the rail portion 1 with wheels 13 of a bogie of the trolley which, for example, runs on the upper rail 1. For vertical suspension and guidance, laterally positioned wheels 14, 14′, and rotatable about vertical axes 141, 141′, can roll off against the vertically positioned end portions 10 of the lower rail 2; other guidance and running arrangements, of course, are possible, and bogie wheels similar to wheels 13 can also engage the lower rail 2 at the bent surface 9 thereof.

The track way can be positioned horizontally, at an inclination, or vertically, and thus can also be used as a guide way for elevator structures or the like, suitably engaged by bogie wheels at the curved surfaces 9 or the straight surfaces 10, or by matching shoes fitting around the surfaces 9, 10, respectively.

Figure 6:
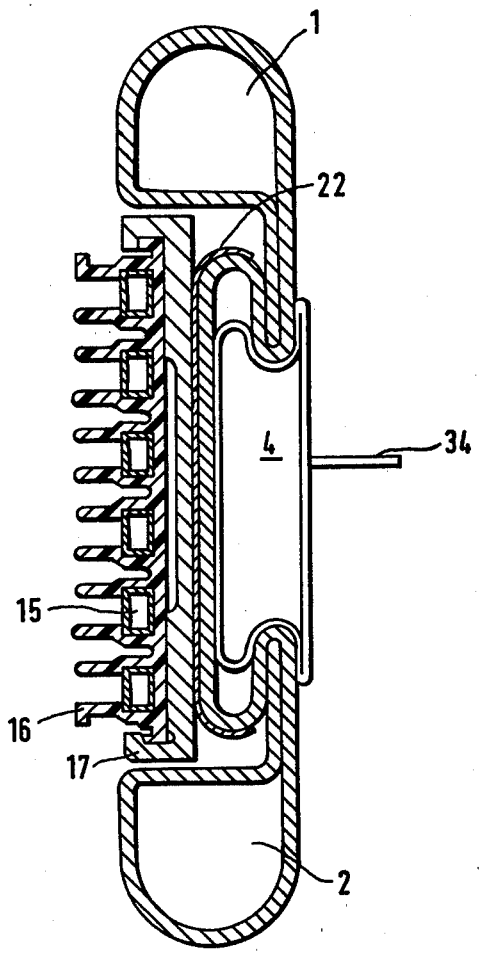
FIG. 6 is a cross-sectional view similar to FIG. 1 with a switching control element inserted in the track way.
Figure 7:
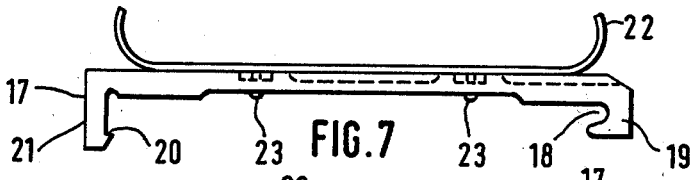
FIG. 7 is a side view of an attachment bracket for current supply tracks as illustrated in FIG. 6.
Figure 8:
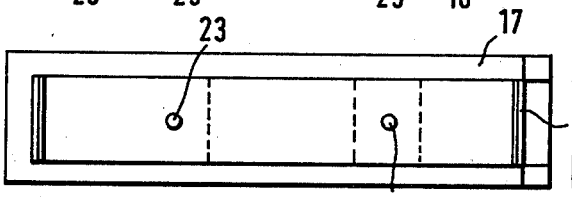
FIG. 8 is a top view of a current supply attachment bracket.

Current supply buses or rails 15 are carried at the side of the back portion 11 of the web 3 which is opposite the opening 4. The current supply rails or buses 15 are positioned in a holder 16, preferably made of insulating material. The holder 16 is held in position in the track way by attachment clips or brackets 17 of elongated U-shaped cross-section. The attachment brackets or clips 17—see also FIGS. 7 and 8—are so shaped that the profiled section 16 can fit an open groove or notch 18 (FIG. 7) of the lower leg 19 of the U-shaped clip, and then hooked in position by the upper leg 21 of the U-shaped clip, which will hold the insulating rail 17 by a terminal projection 20, which can bite into the insulating material. The back portion of the attachment clip 17 have a snap spring 22 of generally U-shaped cross section attached thereto, for example by rivets 23. The snap spring 22, best seen in FIG. 7 and securely attached to the clip 17, can be snapped around the outer surfaces of the rounded portions of the C-like web, as seen in FIGS. 1, 6, the U-shaped spring 22, made of spring steel, merely fitting around the round portion to hold the clip and hence the electrical connecting rail in position. As can be seen, the connecting rail is thus attached to the steel track without requiring any on-the-job drilling or separate installation. The vertical position 11 of the center web, being set back with respect to the outer limit of the vertical portions 10 of the rails 1, 2, likewise places the center portion 11 inwardly of the vertical portion 10 at the other side of the rails 1, 2—at the left side with respect to FIG. 1. Since the center portion 11, preferably, is positioned at the central plane of the track way, the insulating holder 16, together with the electrical connecting rails 15 and the clips 17, is within the overall projected outline of the track way. In a preferred form, the outer surfaces of the electrical connecting buses 15 are at least in approximately vertical alignment with the adjacent vertical surfaces 10 of the upper and lower rails 1, 2. The spring steel clip 22, due to its overlapping engagement with the rounded portion of the C-web 3, reliably holds the insulating body 16, and hence the electrical connecting rails in secure position. The attachment clip 17 can be applied at any desired position of the track way on the web 3 without drilling or forming holes or slits or providing for other attachments on the web 3 itself. Thus, the web 3 is not weakened at selected locations by holes drilled therethrough at possibly undesirable—from a force transfer point of view—positions, and installation of the track way is substantially simplified.

Suspension of the track way, and suspension holders therefor: In a preferred form of the invention, the track way is suspended by generally L-shaped suspension holders 25 (FIG. 4) which, in turn, are supported from support elements—not shown—in any suitable manner, for example in an assembly building, from pylons, or the like. The holders 25 can be secured in any suitable manner, for example by bolts, welding, and can extend from the track way in vertical, upward direction, or downwardly, or in any other suitable manner, as required by external terrain and attachment conditions. Each one of the suspension elements 25 has strip or block-like claws 26 located laterally adjacent the suspension element 25, which form the actual suspension attachment portion. The claws 26 have a height which corresponds to the width of the groove-like opening 4, so that the web 3, and hence the track, is supported at the end portions of the groove-like opening 4 on the claws 26 by force-transfer engagement therewith—see FIG. 13. The claws 26 project into the interior of the C-like opening or pocket of the web 3. Two clamping bars 27 are located within the pocket-like opening of the web 3. The clamping bars, upon rotation from a position shown in broken lines in FIG. 3 to a verticxal, full-line position—see the arrow A at the left claw 27, FIG. 3—provides for engagement of the clamping bars against the inner legs 5 forming the wing portions of the C-web. Bolts or screws 28 then clamp the bars 27 to the claws 26, the outer portions 29 of the claws 26 bearing against the outer portions 6 of the C-wings of the web 3.

Figure 10:
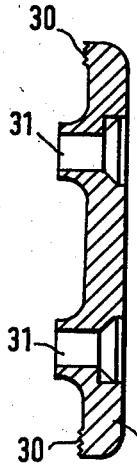
FIG. 10 is a section through the claw of FIG. 9, taken along line X—X of FIG. 9.
Figure 9:
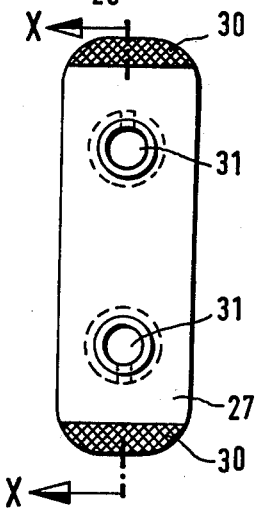
FIG. 9 is a top view of a clamping claw, shown in assembled position in FIG. 3.

The clamping bars 27 are shown in detail in FIGS. 9 and 10. Each one of the clamping bars 27 is formed at its end portions with knurled engagement surfaces 30 and has two tapped bars 31 extending therethrough. The dimensions of the clamping bars 27 is so selected that, in assembly, they are first placed in the position shown in FIG. 3 in broken lines, that is, horizontally, at which time they can be readily introduced through the groove-like opening 4 of the web 3. Thereafter, they are rotated by 90° in the vertical clamping position, so that they can no longer be pulled out from the groove opening 4 and fit within the interior pocket formed by the C-web 3. After placement of the track way on the claws 26 of the previously positioned hangers or support elements 25, screws 28 are tightened, which clamps the claws 27 against the wing portions 5 of the web 3. If it is desired to re-position the track way or to allow for change in location of the hangers or support elements 25, for example to compensate due to settling, shifting, or for other reasons, it is only necessary to loosen the bolts 28 and the track way can be shifted longitudinally with respect to the suspension hanger. The absence of attachment holes substantially simplifies placement of the track way, while contributing to the overall strength thereof. The position of the suspension elements 25 with respect to the track way can thus be exactly predetermined prior to tightening the bolts 28. Thus, the track way can be precisely positioned without constraint by pre-drilled attachment holes which must fit against pre-positioned hangers—making alignment extremely difficult. Since the track way is supported by force-transfer engagement on the claws 26, the forces due to the inherent weight of the track way, and due to such loading as is placed thereon upon the passage of trolleys or other suspended devices can be transferred directly to the support elements 25. The clamping bolts 28 are stressed only in tension, to attach the suspension elements 25 and not in shear, since the track can rest directly on the claws 26, or on similarly formed fitting projections elements secured to, or integral with, the suspension elements 25.

Figure 5:
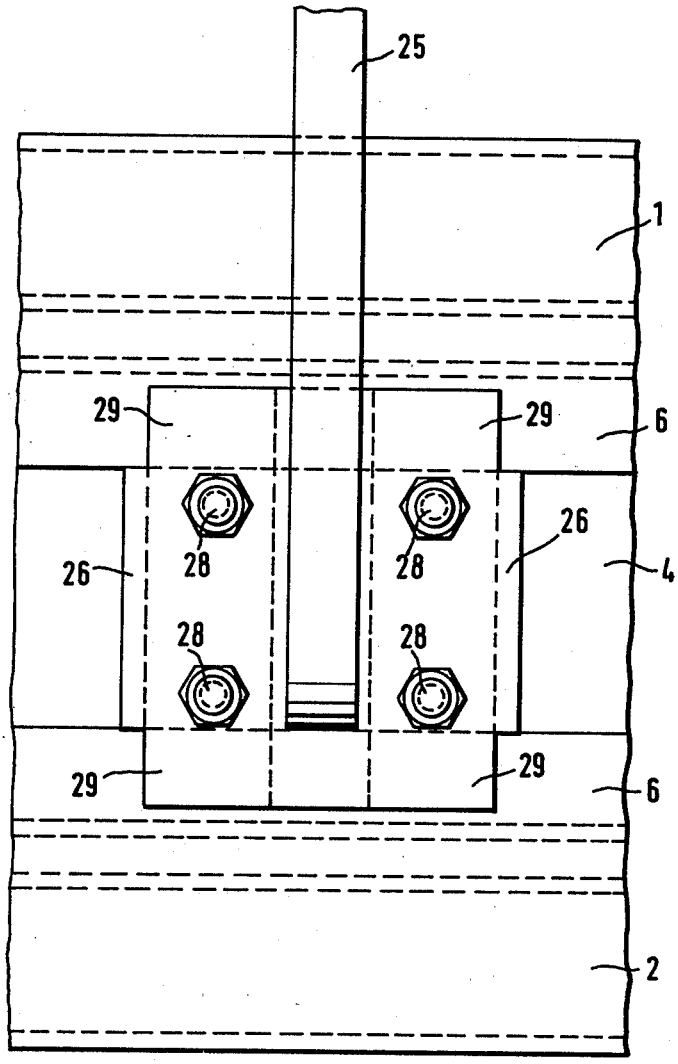
FIG. 5 is a back view taken along the direction of arrow C of FIG. 4.
Figure 13:
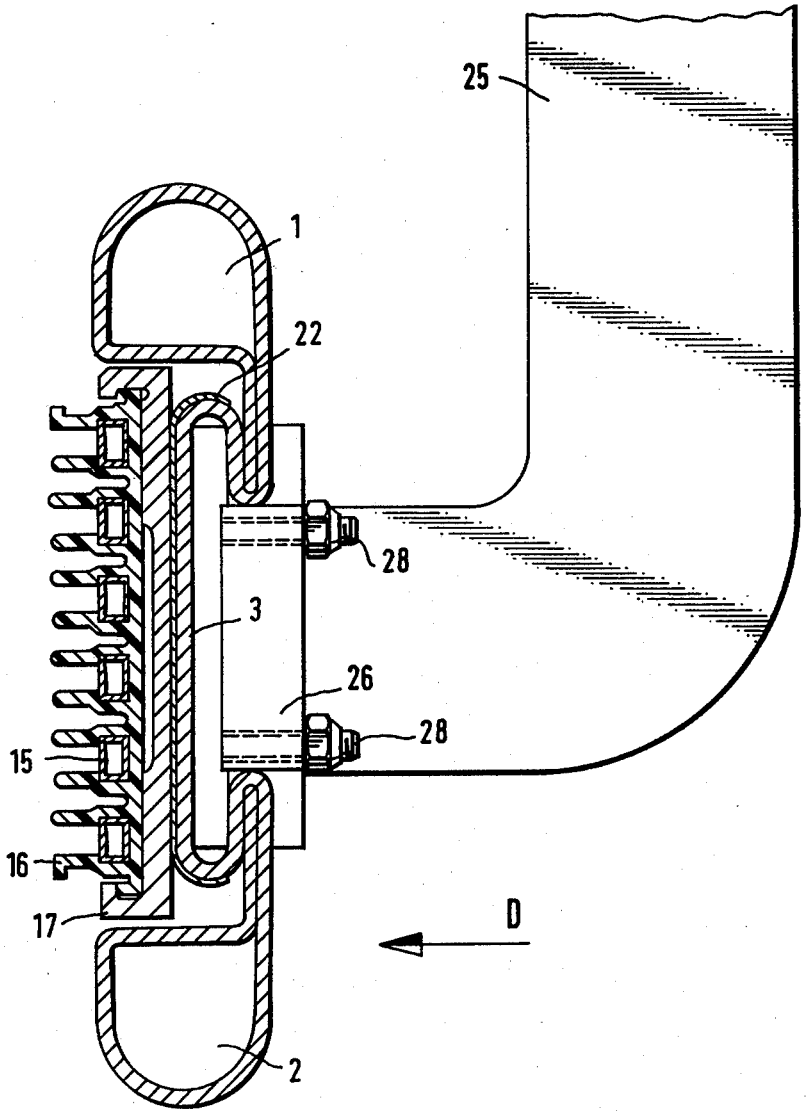
FIG. 13 is a cross-sectional view of the track way of FIG. 1 illustrating a connecting support hanger to connect adjacent sections or portions of the track way while being suspended at the connection or butt junction.
Figure 14:
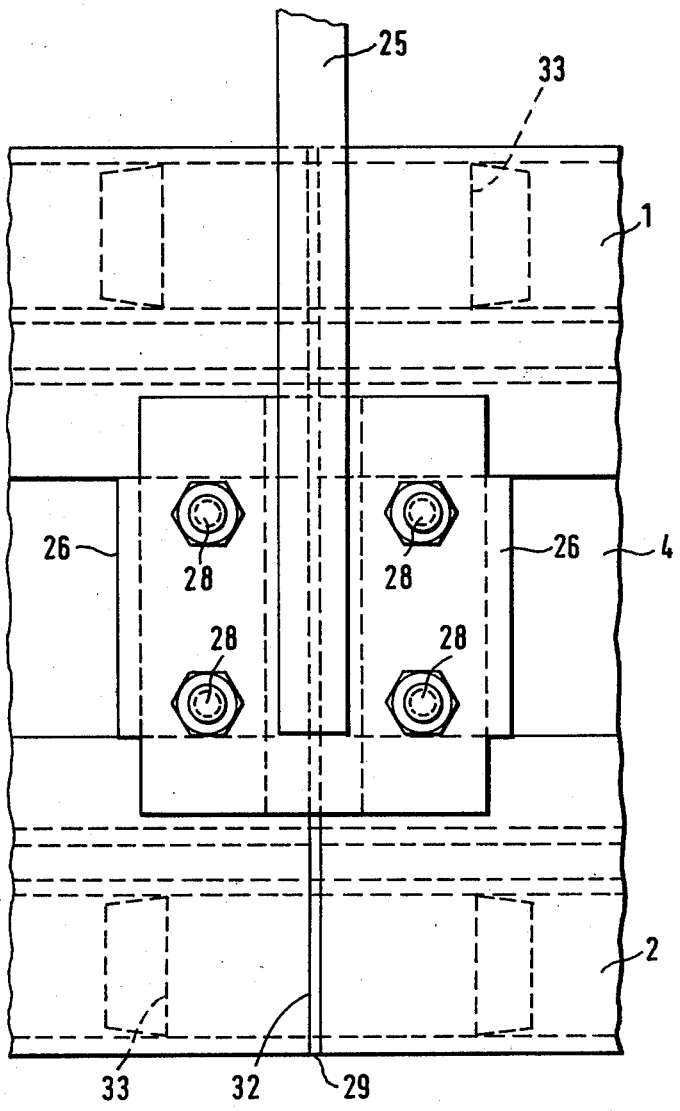
FIG. 14 is a view of the butt connection of FIG. 13 taken along arrow D of FIG. 13.

Two track sections can readily be connected by claws 26 (FIGS. 5, 13, 14) which can also act as connecting junctions. FIGS. 13–14 illustrate connection of two track sections, butt-joined end-to-end at a suspension element 25. Claws 26—see FIG. 14—extend at both sides of butted track sections. The butt joint is shown at 32. Two clamping bars or clamping claws 26 are provided, one each being clamped to one of the track sections. Since the track ways at the end portions of the opening 4 are engaged by, and in force transfer relation to, the respective claws 26 of the suspension element 25, no bending, buckling or separation of the track sections at the butt junction can occur. To compensate for tolerances, and provide for additional stiffening, as well as to insure exact alignment of the outer surfaces of the rail portions 1, 2 of the respective track sections, interiorly fitting connecting elements 33 in the form of connecting pins are preferably introduced into the interior of the rail portions 1, 2 of the adjacent track sections to be butted, so that the rail sections are pushed together and secured together by the additional connecting pins 33. The connecting pins 33, themselves, need not be solid but can be tubular elements suitably shaped to fit within the rail portions 1, 2. They are held within the rail portions by an interference fit. Additional attachment may be used, for example by forming an axially extending slit, and passing a bolt with end nuts through an axially aligned opening with accessibility through a gap at the butt 32 for turning of the bolt, so that the connecting pins 33 can be expanded by turning a connecting bolt, similarly to turning of a turn buckle.

Figure 11:
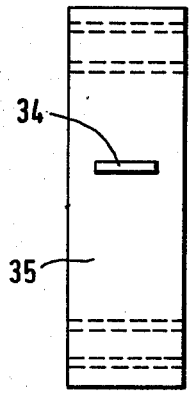
FIG. 11 is a front view of an attachment element for the operating or control element shown in FIG. 6.

Many track ways, particularly for automatic guidance of suspended trolleys or other suspension elements thereon, preferably have switching or other engagement or abutment elements secured thereto, to be engaged by guide projections placed on the trolleys to program the track path, for example. An abutment element associated with the track ways is shown in FIG. 6, and in detail in FIGS. 11 and 12, see element 34.

The operating element or flag 34 extends from the groove-like opening 4 laterally, for example in the direction of the support hangers, although it can be extended, for example in form of a flag, upwardly or downwardly to project beyond the terminal limits of the rails 1, 2 for engagement by a moving trolley.

Figure 12:
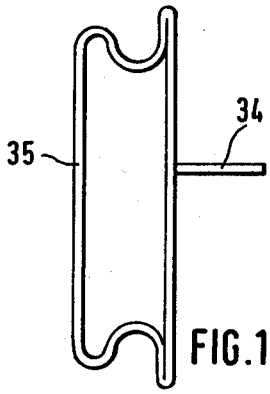
FIG. 12 is a side view of the element of FIG. 11.

The abutment element 34 is formed of a resiliently deflectable inner part 35 which matches, and fits into, the hollow pocket formed by the web 3, as best seen in FIGS. 6 and 12. The shape is such that it fits snugly around the wing portions of the C of the web 3. Preferably, the element 34 is made of spring steel and can be elastically, removably or releasably clamped in the track way, as best seen in FIG. 6. The element 34 can be placed at any position, as desired, and its particular shape is determined by the overall design of the track way and trolley system. The fitting of the operating element 34 can also be so positioned that the flag portion extends in at least partly blocking position within the open pocket formed by the groove-like opening 4, for engagement by deflectable sensing elements secured to the trolleys running on the track way. As can be seen in FIG. 6, the engagement element 34 preferably is so shaped that the inner wall portion thereof fits against the central web 11 of the web 3.

The closed hollow end portions 1, 2 form a structural element of high strength for a running rail of the wheels of the trolley, while having the advantage that the track way can readily be adapted to terrain or surrounding conditions, and can be bent over comparatively small radii of curvature. The free ends of the metal strip, bent in the shape as described, are clamped between the reentrant portions 5, 6 of the wings defining the ends of the C-groove which results in a compact, and strong construction resisting twist even upon application of substantial loads by the wheels 13 of a bogie supporting a trolley. An overall stable track way is thereby provided.

The lateral dimensions of the track way can readily be maintained to fit, essentially, within the outline of the rail portions 1, 2, so that the current supply buses, and control buses and the like, can be fitted on the track way without projection beyond its vertical outline. Insulating extensions, to provide guidance for current pick-up brushes or the like, can be provided as required.

The track way is not restricted to hangers placed at specific locations; the supports 25 can be placed where convenient, and any possible misalignment of the placement of the support from predetermined positions is irrelevant since the support 25 (FIG. 4) can be shifted longitudinally with respect to the track as required. The clamping rods or plates 27 can be introduced into C-groove and rotated in position, then clamped loosely while the alignment of the support element 25 with the track is adjusted. When the track and support element 25 are in proper position, the clamping bolts are tightened and the track way is securely supported. Thus, the support of the track way can be adjusted during installation; tolerances in placement of the support elements 25 can be readily compensated by longitudinal shifting of the track way with respect to the support elements.

The control elements 34, 35 can be placed in the C-groove at any desired position. If the arrangement of possibly projecting elements from the trolleys is such that the projecting flags 34 are subjected to impact forces, longitudinal shift of the inserts can be prevented by clamping them in position with clamping plates, similar to the plates 27 used in connection with the attachment of the hanger elements. Positioning of the elements 34, thus, will be reliable and yet can be changed, as desired, by merely loosening clamping elements and shifting the elements 34 longitudinally, again without requiring any redrilling of material of the track way.

Various lengths of track way can be provided; if it is desired to join an element shorter than a manufactured unit, it can be cut by a metal saw, and joined as described in connection with FIGS. 13 and 14 to an existing length, without again requiring any drilling, fishplates or the like. The attachment elements, and particularly the jaws or abutment portions 26 thereof, which bear against the ends of the wing portions 5, 6 of the track way, accept the forces due to the weight of the trolleys directly. Thus, any snapping, bending or misalignment of adjacent track ways at a joint is effectively prevented. Connecting pins can be used to additionally stiffen the connection, introduced into the hollow rails portions 1, 2 and held therein, for example, by an interference fit or by expansion and frictional engagement of an end portion which is expanded by tightening a conical insert thereagainst.

Various changes and modifications may be made, and various utilitarian features can be used with others, within the scope of the inventive concept.

I claim:

1. Suspended track for monorail suspended trolleys having an upper hollow structural section (1);

a lower hollow structural sections (2);

and a connecting web (3) connecting said upper and lower sections together, adapted to be supported by hanger elements (25) laterally attachable to said web, and further being adapted to support electrical connection tracks, buses or rails (15), said connecting web being a unitary element integral with the upper and lower hollow structural section and defining a central portion, and mutually approaching end portions leaving, between the ends (8) thereof, an open space;

and wherein, in accordance with the invention, the central portion of the generally C-cross-sectionally shaped connecting web forms a back portion (11);

the end portions of said web extend forwardly from the back portion, converging towards each other and leaving, between the ends (8) thereof, a groove-like open gap (4) which defines said space;

and mutually diverging wing portions (6) are provided extending upwardly and downwardly away from said gap (4), said wing portions merging into said upper and lower hollow structural sections (1, 2) and extending to form upper and lower hollow structural portions, respectively, of said sections.

2. Track according to claim 1, wherein said upper and lower structural portions (1, 2) of said upper and lower hollow sections and said connecting web (3) comprise a unitary cold-rolled formed or shaped profiled rail.

3. Track according to claim 1, wherein said upper and lower hollow structural sections (1, 2) and said web (3) are a single unitary formed or shaped profiled rail rolled from a single strip of material;

and wherein the end portions (7) of the strip of material extend from the upper and lower structural sections, respectively, and are positioned between the mutually converging or approaching forward portions (5) of the generally C-shaped web (3) and the mutually diverging wing portions (6) extending therefrom, said converging forward portions and wing portions extending in parallel direction and forming generally U-folded parallel legs, the end portions (7) of the strip being fitted between said parallel legs (5, 6) and clamped therebetween.

4. Track according to claim 3, wherein the ends of said end portions (7) bear against the bottom of the U-shaped converging and diverging portions (5, 6) to provide for force transfer to the bottom (8) of said converging and diverging portions, and to hold said end portions (7) in position and support said end portions (7) against twist.

5. Track according to claim 1, wherein said web (3) is set back with respect to a projection of the outer edges (10) of said upper and lower hollow structural sections (1, 2).

6. Track according to claim 5, wherein the back portion (11) of said web (3) is placed approximately at a vertical center line extending through said upper and lower hollow structural section.

7. Track according to claim 1, further including an elongated support body (16) of insulating material carrying electrical connection tracks, buses or rails;

and resilient holding clips (22) secured to said elongated insulating support body (16) and having bent portions fitting over the outer surface of the rounded region of the C-shaped web.

8. Track according to claim 7, wherein said resilient clips comprise spring sheet metal clips secured to said elongated insulated support body at spaced longitudinal positions at a side thereof opposite that of the electrical connection tracks, buses or rails (15) and shaped to resiliently snap over the rounded portion of the web (3) from the side opposite said groove-like open gap (4).

9. Track according to claim 1, in combination with hanger elements (25);

wherein said hanger elements include bearing claws (26) fitting between said groove-like gap (4) and supporting the adjacent mutually converging forward portions (5) and said mutually diverging wing portions (6);

clamping bars or plates (27) fitting within the space defined by the C-shaped web interiorly of the space and bearing from the inside against said converging forward portions (5);

and clamping means (28) clamping said bars or plates against the hanger element (25).

10. Track according to claim 9, wherein said clamping bars or plates (27) are movable and have one dimension which is less than the width of the groove-like gap (4) to permit introduction of said clamping bars or plates (27) through said groove-like open gap for subsequent rotation into clamping position.

11. Track according to claim 9, wherein the dimensions of said clamping bars or plates are less than the clear transverse distance of said C-shaped web to permit sliding of the clamping bars or plates and the attachment elements longitudinally with respect to the track.

12. Track according to claim 9, wherein the hanger element (25) is formed with an abutment portion including said claws, said abutment portion bearing against and supporting the structural sections and said web, and any trolleys thereon, by engagement of said abutment portion with the junction of said converging forward portions and said wing portions.

13. Track according to claim 9, wherein said clamping means comprises tension bolts (28) clamping the clamping bars or plates (27) against the hanger element, said hanger element.

14. Track according to claim 1, further including operating or control elements (34) positioned within the chamber defined by the generally C-shaped cross section of the web, and having an extension flag (34) extending outwardly from the groove-like open gap (4).

15. Track according to claim 14, wherein said operating control elements are shaped to fit within the chamber defined by the C-shaped cross section of the web and include clamping means (35) positioning said elements in longitudinally defined position.

16. Track according to claim 1, wherein at least one of said structural sections (1, 2) is formed with vertically extending plane side portions (10) projecting beyond the position of said back portion (11) of the web to permit rolling contact with guide rollers or wheels (14) of a trolley, rotating about vertical axes.

17. Track according to claim 1, in combination with coupling elements to couple two tracks together in longitudinally abutting alignment, said coupling elements comprising a bearing claw (26) having a longitudinal width spanning the abutment joint (32) of two adjacent tracks, fitting within the groove-like open gap (4) and having portions extending from the outside over said diverging wing portions (6) and abutment shoulders fitting against the bent-over ends (8) formed by adjacent converging portions (5) of the web and the diverging wing portions (6);

and clamping bars or plates (27) positioned within the chamber defined by the C-shaped cross section of the web (3) bearing against the converging portions (5) from the inside of said chamber and in clamping connection with said outwardly overlapping portions positioned at both said tracks to connect said tracks together.

18. Track according to claim 17, further including connecting pins (33) fitted within the hollow space of at least one of said hollow structural sections (1, 2), and frictionally secured therein.

19. Track according to claim 1, wherein the upper and lower hollow structural sections are—in cross section—closed box-like hollow rails.

20. Track according to claim 19, wherein the ends of the wing portions have end parts which have a zone which is bent backwardly in the direction of the back portion, and a further zone bent forwardly meeting the wing portions in the region where they, respectively, extend upwardly and downwardly to define said hollow box-like rails between the backwardly bent and forwardly bent zones.

* * * * *

UNITED STATES PATENT AND TRADEMARK OFFICE

CERTIFICATE OF CORRECTION

PATENT NO. : 4,393,785

DATED : July 19, 1983

INVENTOR(S) : Franz Hörtnagel

It is certified that error appears in the above—identified patent and that said Letters Patent is hereby corrected as shown below:

In the Abstract:

Change line 13 to read: ends (7) of the hollow structural sections being clamped between the converging portions (5) and the diverging wing.

Claim 1, col. 8, line 18 change "section" to -- sections --.

Claim 13, col. 10, line 2, delete "said hanger element".

Signed and Sealed this

*Twenty-seventh* Day of *March 1984*

[SEAL]

*Attest:*

GERALD J. MOSSINGHOFF

*Attesting Officer*

*Commissioner of Patents and Trademarks*